US011128060B2

(12) United States Patent
Liu

(10) Patent No.: US 11,128,060 B2
(45) Date of Patent: Sep. 21, 2021

(54) MULTI-BAND ANTENNA MODULE

(71) Applicants: ASKEY COMPUTER CORP., New Taipei (TW); ASKEY TECHNOLOGY (JIANGSU) LTD., Jiangsu (CN)

(72) Inventor: Chien-Sheng Liu, Taoyuan (TW)

(73) Assignees: ASKEY COMPUTER CORP., New Taipei (TW); ASKEY TECHNOLOGY (JIANGSU) LTD., Jiangsu (CN)

( * ) Notice: Subject to any disclaimer, the term of this patent is extended or adjusted under 35 U.S.C. 154(b) by 15 days.

(21) Appl. No.: 16/716,517

(22) Filed: Dec. 17, 2019

(65) Prior Publication Data

US 2021/0005984 A1 Jan. 7, 2021

(30) Foreign Application Priority Data

Jul. 3, 2019 (TW) ..... 108123420

(51) Int. Cl.

| | |
|---|---|
| ***H01Q 1/24*** | (2006.01) |
| ***H01Q 21/30*** | (2006.01) |
| ***H01Q 5/314*** | (2015.01) |
| ***H01Q 1/42*** | (2006.01) |

(52) U.S. Cl.

CPC ..... *H01Q 21/30* (2013.01); *H01Q 1/42* (2013.01); *H01Q 5/314* (2015.01)

(58) Field of Classification Search

CPC ..... H01Q 21/30; H01Q 5/314

USPC ..... 343/893, 846, 861

See application file for complete search history.

(56) References Cited

U.S. PATENT DOCUMENTS

| | | | | |
|---|---|---|---|---|
| 9,484,631 | B1 * | 11/2016 | Napoles | H01Q 5/371 |
| 2010/0182215 | A1 * | 7/2010 | Hsiao | H01Q 1/38 343/846 |
| 2015/0002339 | A1 * | 1/2015 | Lin | H01Q 9/0421 343/700 MS |
| 2015/0061960 | A1 * | 3/2015 | Liou | H01Q 5/335 343/861 |

* cited by examiner

*Primary Examiner* — Peguy Jean Pierre
(74) *Attorney, Agent, or Firm* — JCIPRNET

(57) ABSTRACT

A multi-band antenna module is adapted to be disposed on a casing. The multi-band antenna module includes a main radiator, and a first, a second, a third and a fourth radiator. The main radiator has a feed-in terminal and a first ground terminal. The first radiator is connected to the main radiator and configured to couple a first frequency band. The second radiator is connected to the main radiator and configured to couple a second frequency band. The third radiator is connected to the main radiator and configured to couple a third frequency band. The fourth radiator is located beside the main radiator and configured to couple a fourth frequency band and has a second ground terminal. The main radiator, the first radiator, the second radiator, the third radiator and the fourth radiator are adapted to form a 3D structure along an outline of the casing.

8 Claims, 9 Drawing Sheets

MULTI-BAND ANTENNA MODULE

CROSS-REFERENCE TO RELATED APPLICATION

This application claims the priority benefit of Taiwan application serial no. 108123420, filed on Jul. 3, 2019. The entirety of the above-mentioned patent application is hereby incorporated by reference herein and made a part of this specification.

BACKGROUND OF THE INVENTION

1. Field of the Invention

The present invention generally relates to an antenna module, in particular, to a multi-band antenna module.

2. Description of Related Art

At present, a multi-band antenna is usually disposed on a substrate in a planar form. Along with progress of sciences and technologies, electronic products are developed towards thin and small sizes. Matching of a multi-band antenna and a substrate may occupy a relatively large internal space of an electronic product, which makes it difficult to reduce a size of the electronic product.

SUMMARY OF THE INVENTION

The present invention provides a multi-band antenna module, which may couple multiple frequency bands and be disposed along an outline of a casing to save the space.

A multi-band antenna module of the present invention is adapted to be disposed on a casing. The multi-band antenna module includes a main radiator, a first radiator, a second radiator, a third radiator and a fourth radiator. The main radiator has a feed-in terminal and a first ground terminal. The first radiator is connected to the main radiator and configured to couple a first frequency band. The second radiator is connected to the main radiator and configured to couple a second frequency band. The third radiator is connected to the main radiator and configured to couple a third frequency band. The fourth radiator is located beside the main radiator and configured to couple a fourth frequency band and has a second ground terminal. The main radiator, the first radiator, the second radiator, the third radiator and the fourth radiator are adapted to form a 3D structure along an outline of the casing.

In an embodiment of the present invention, the casing has a bottom surface, a top surface and multiple lateral surfaces between the bottom surface and the top surface, the main radiator has two branches, the feed-in terminal and the first ground terminal are located on the two branches respectively, the feed-in terminal and the first ground terminal are adapted to be located on the bottom surface, and the two branches have multiple bends and thus are adapted to extend from the bottom surface to the top surface along at least one of these lateral surfaces.

In an embodiment of the present invention, the casing has a top surface and a lateral surface, and the first radiator has a bend and thus is adapted to extend from the top surface to the lateral surface.

In an embodiment of the present invention, the casing has multiple lateral surfaces, and a part, on one lateral surface, of the first radiator resonates in the first frequency band.

In an embodiment of the present invention, the casing has multiple lateral surfaces, the first radiator has an end portion connected to the main radiator, the first radiator has a first widened section, a second widened section and a third widened section which are adapted to be located on three of these lateral surfaces respectively, and widths of the first widened section, the second widened section and the third widened section are larger than a width of the end portion.

In an embodiment of the present invention, the casing has multiple lateral surfaces, and the second radiator has a first section and a second section which are connected with each other in a bending manner and adapted to be disposed on two of these lateral surfaces.

In an embodiment of the present invention, a width of the first section is larger than a width of the second section.

In an embodiment of the present invention, the third radiator is adapted to be disposed on the top surface.

In an embodiment of the present invention, the casing has a bottom surface, a top surface and multiple lateral surfaces between the bottom surface and the top surface, and the fourth radiator has multiple bends and thus is adapted to extend from the bottom surface to the top surface through at least two of these lateral surfaces.

In an embodiment of the present invention, the multi-band antenna module further includes a variable capacitor electrically connected to the feed-in terminal.

Based on the above, the multi-band antenna module of the present invention has the main radiator, the first radiator, the second radiator, the third radiator and the fourth radiator and thus may couple multiple frequency bands. In addition, the multi-antenna module of the present invention is adapted to form the 3D structure along the outline of the casing, thereby effectively saving the space.

In order to make the aforementioned features and advantages of the present invention comprehensible, embodiments accompanied with accompanying drawings are described in detail below.

DESCRIPTION OF THE EMBODIMENTS

Figure 1:
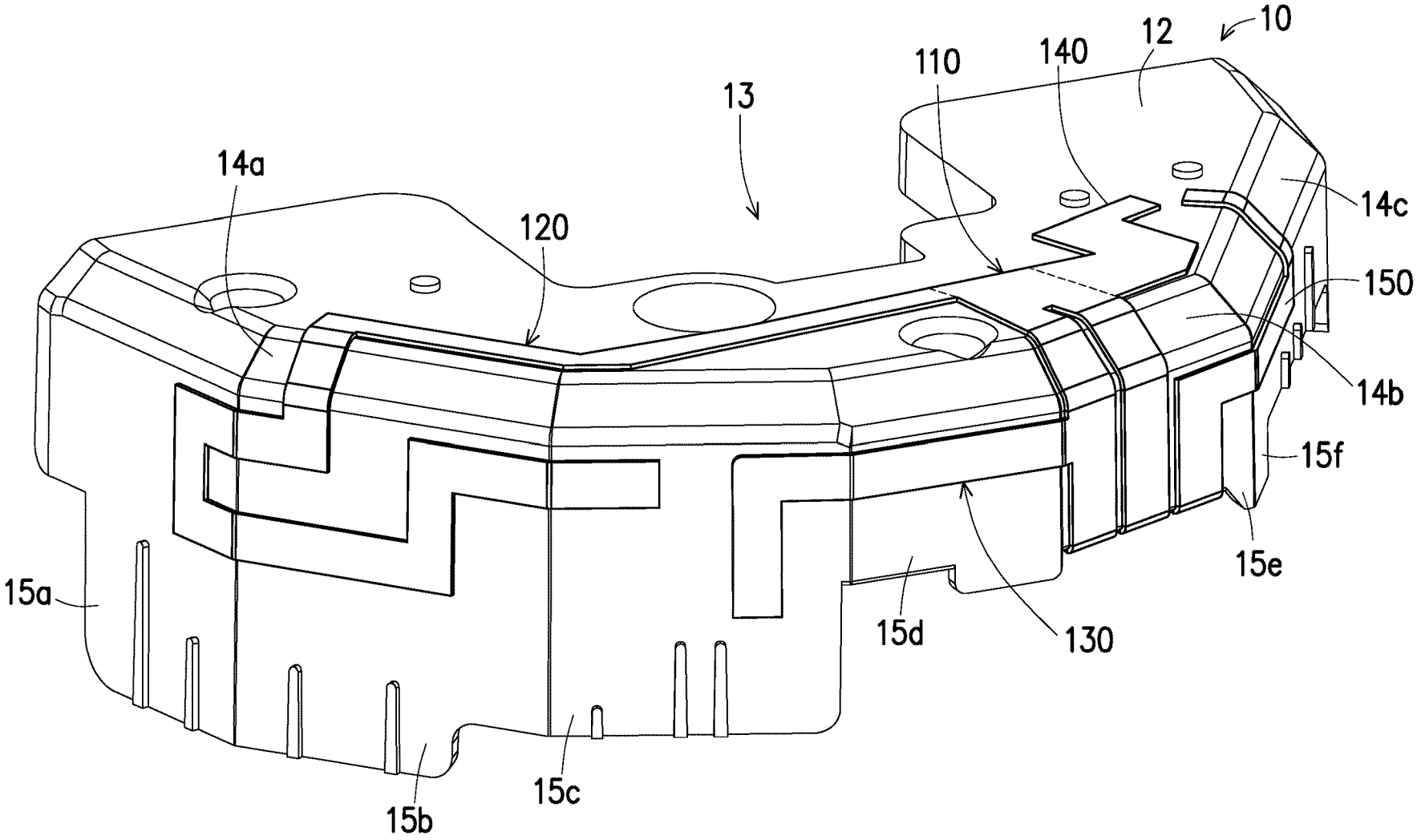
FIG. 1 is a schematic diagram of a multi-band antenna module disposed on a casing according to an embodiment of the present invention.
Figure 2:
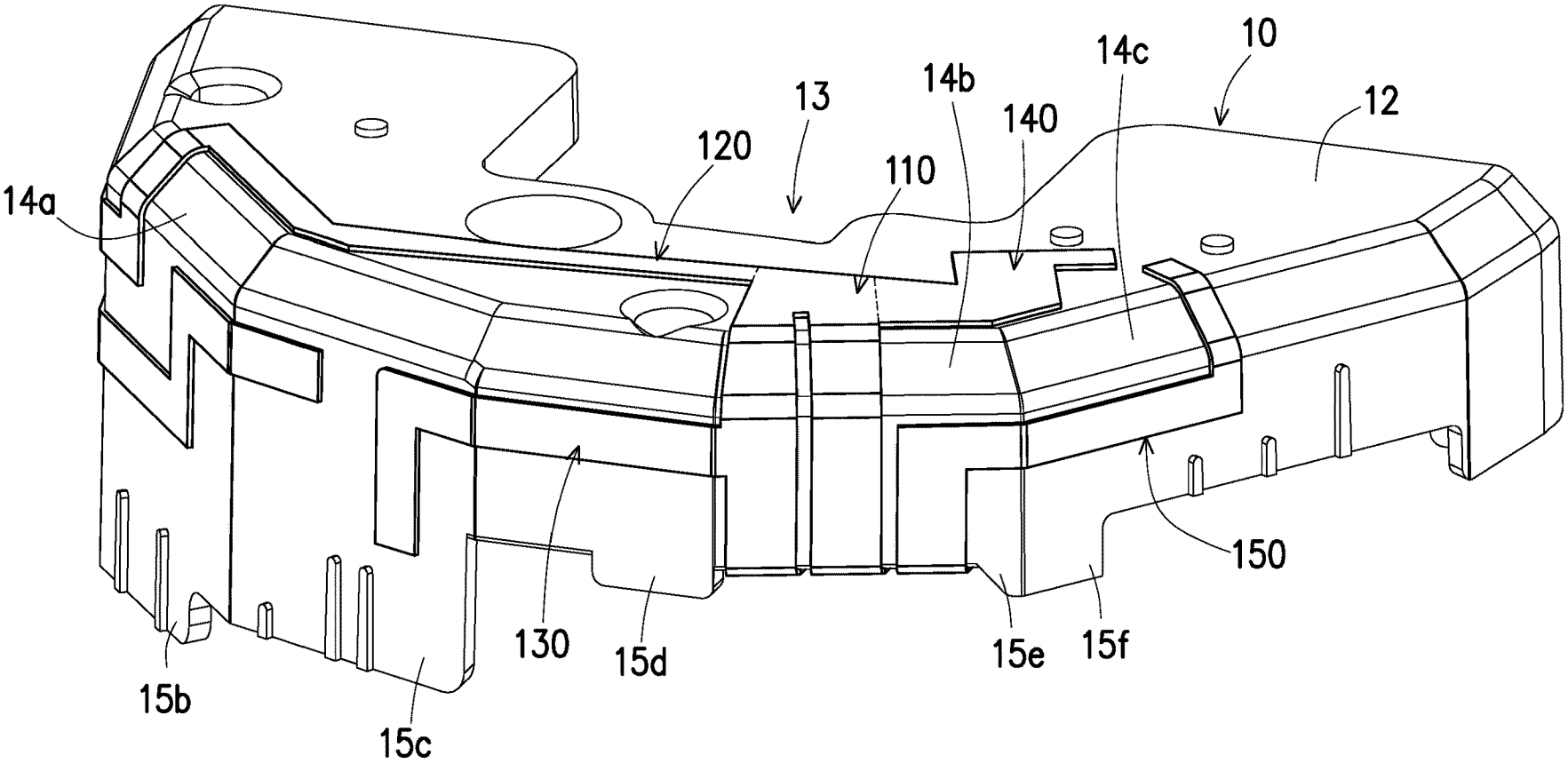
FIG. 2 is a schematic diagram of FIG. 1 at another viewing angle.
Figure 3:
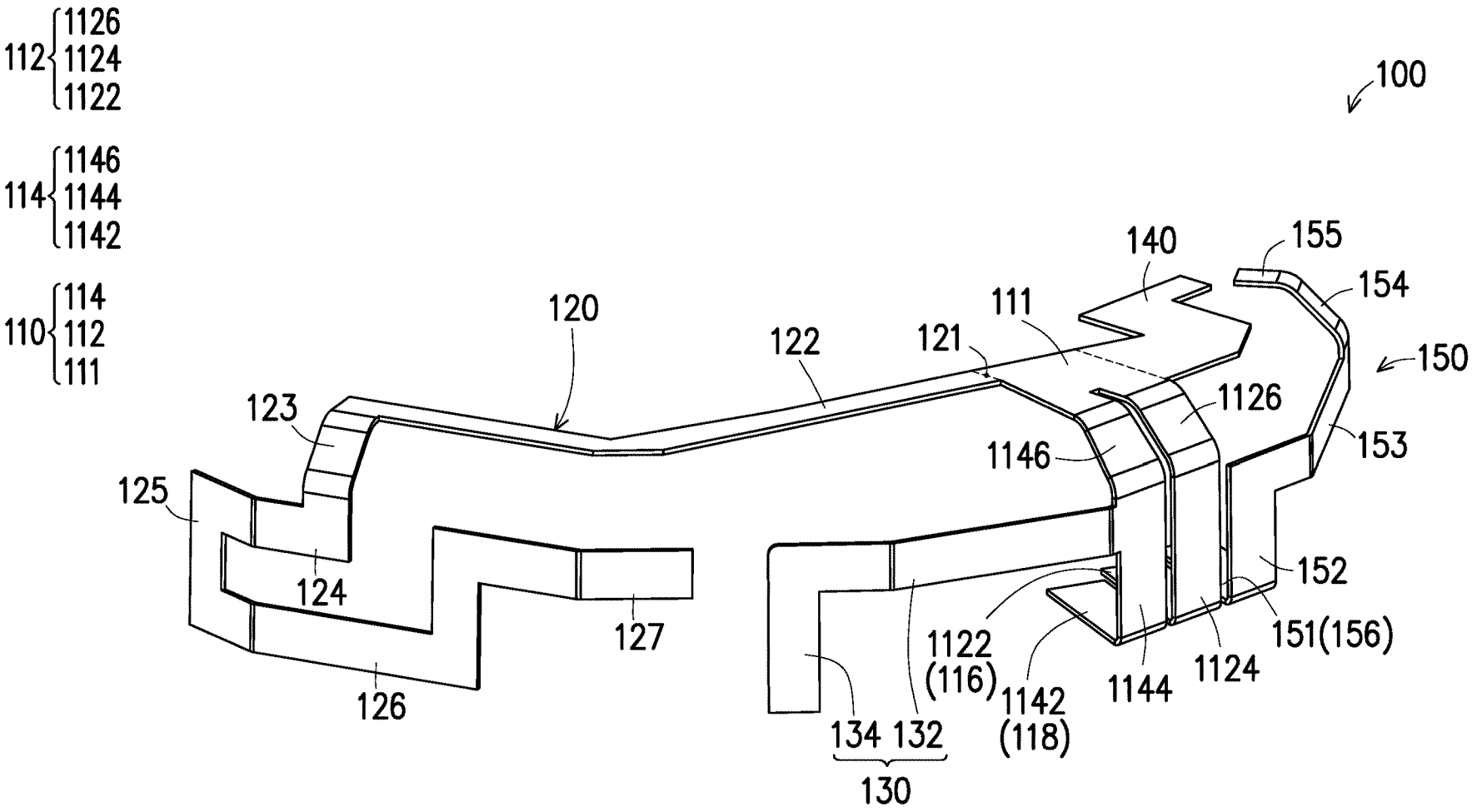
FIG. 3 and FIG. 4 are schematic diagrams with the casing in FIG. 1 and FIG. 2 hidden.
Figure 4:
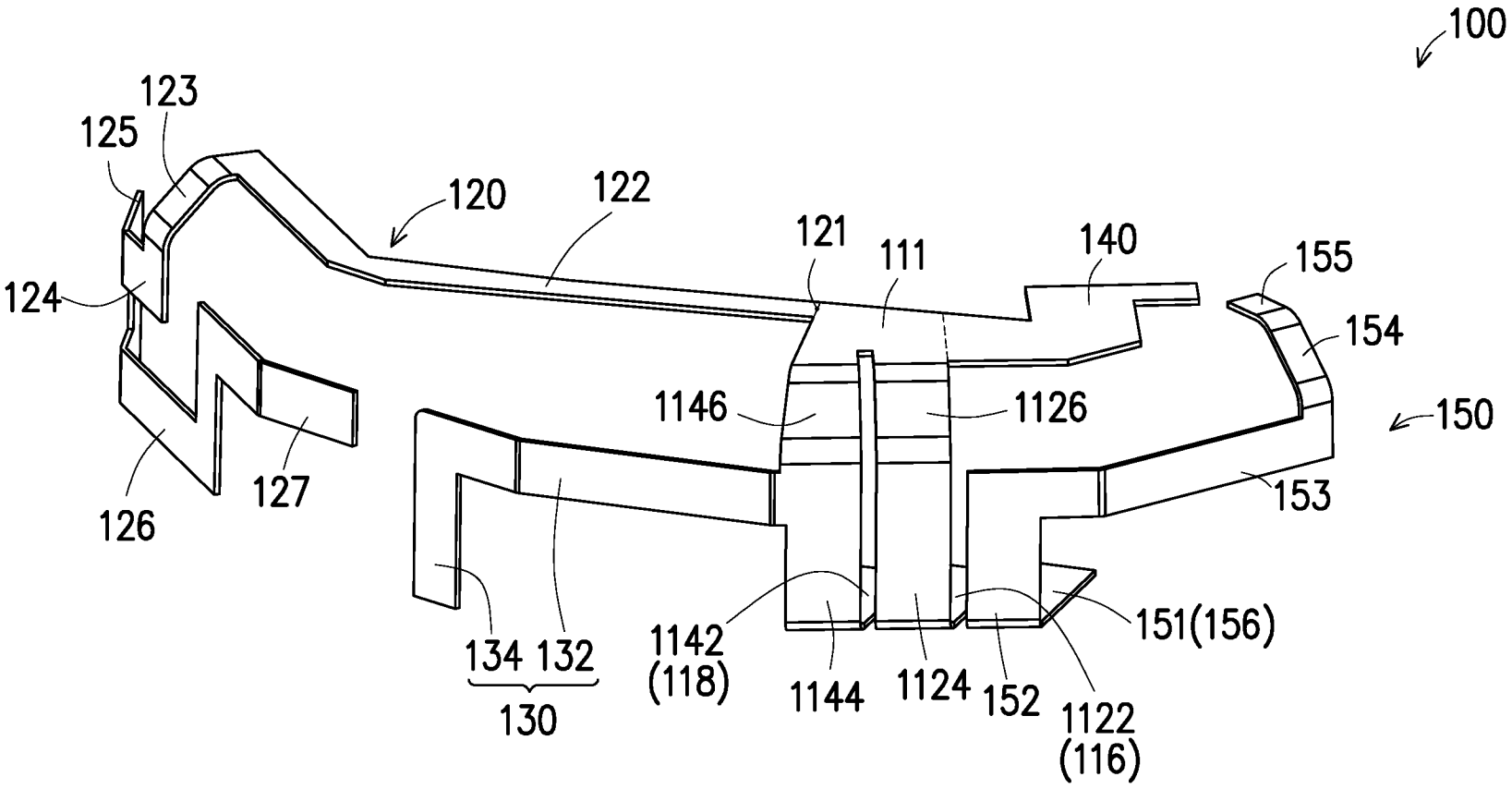
Figure 5:
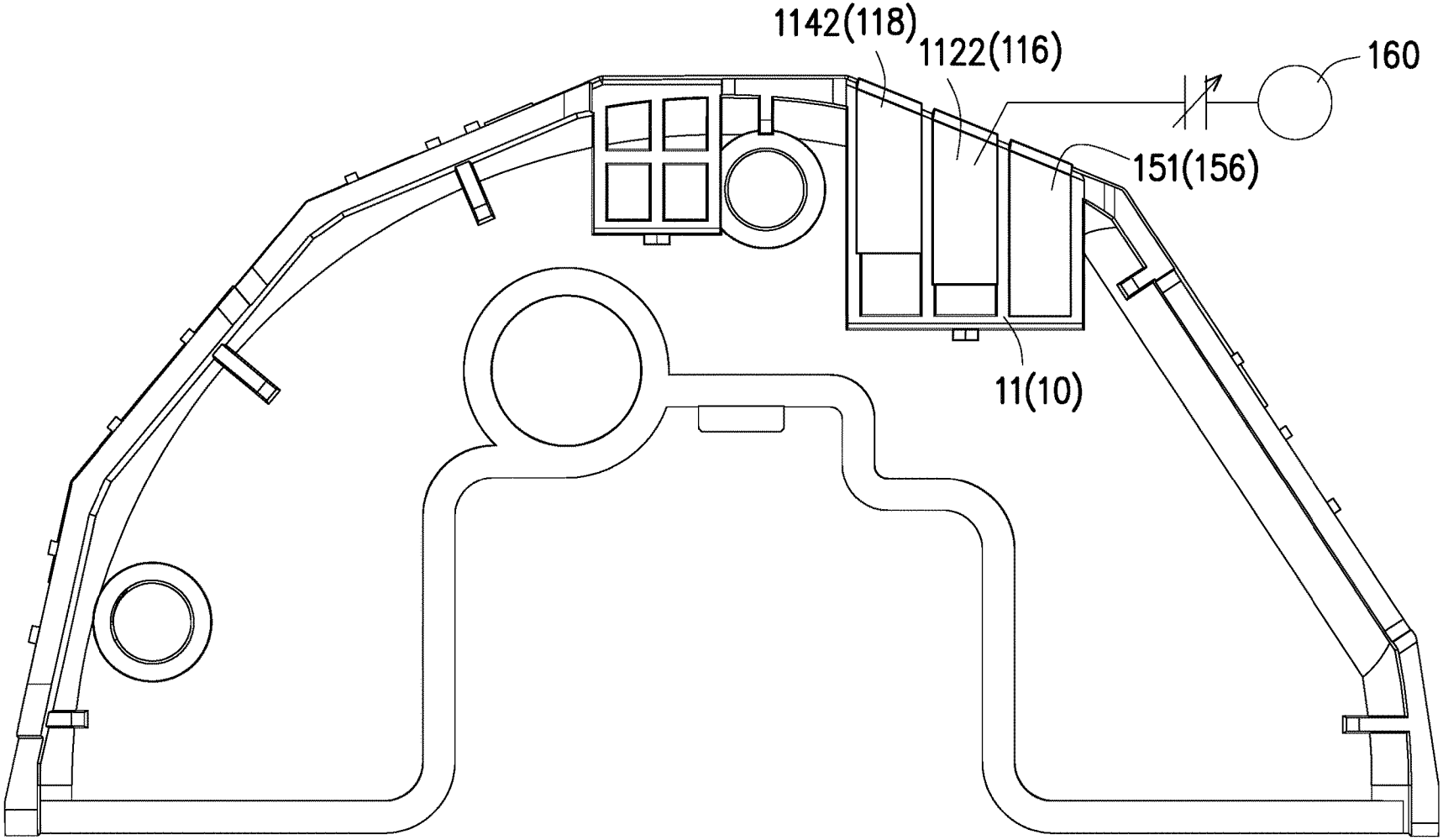
FIG. 5 is a schematic diagram of FIG. 1 at another viewing angle.

FIG. 1 is a schematic diagram of a multi-band antenna module disposed on a casing according to an embodiment of the present invention. FIG. 2 is a schematic diagram of FIG. 1 at another viewing angle. FIG. 3 and FIG. 4 are schematic diagrams with the casing in FIG. 1 and FIG. 2 hidden. FIG. 5 is a schematic diagram of FIG. 1 at another viewing angle. Referring to FIG. 1 to FIG. 5, the multi-band antenna module 100 of this embodiment may be applied to, for example, an automobile data recorder, a digital video recorder (DVR), the Internet of things (IoT) or a mobile phone, and may upload information of an electronic device to a cloud system. Certainly, application of the multi-band antenna module 100 is not limited thereto.

In this embodiment, the multi-band antenna module 100 is adapted to be disposed on a casing 10. As shown in FIG. 1 and FIG. 2, in this embodiment, the casing 10 has a top surface 12, multiple inclined surfaces (only part of inclined surfaces 14*a*, 14*b* and 14*c* are marked) and multiple lateral surfaces 15*a*, 15*b*, 15*c*, 15*d*, 15*e* and 15*f*. In addition, as shown in FIG. 5, the casing 10 has a bottom surface 11. These inclined surfaces 14*a*, 14*b* and 14*c* and these lateral surfaces 15*a*, 15*b*, 15*c*, 15*d*, 15*e* and 15*f* are located between the bottom surface 11 and the top surface 12.

In this embodiment, a shape of the casing 10 is irregular. For example, these lateral surfaces 15*a*, 15*b*, 15*c*, 15*d*, 15*e* and 15*f* of the casing 10 are spliced into a 3D shape close to an arc or a semicircle. However, the shape of the casing 10 is not limited thereto. In an embodiment, the casing 10 may also be of a 3D shape with a local arc, or, the casing 10 may also be of a combination of polygons or of a regular shape (for example, a common polygonal body).

Due to increasing reduction of sizes of present electronic products, in this embodiment, the multi-band antenna module 100 is directly disposed on these surfaces of the casing 10 along outline bends of these surfaces to reduce a space occupied by the multi-band antenna module 100 in an electronic product, and may also be applied well to an irregularly shaped casing 10 to achieve a good multi-band effect. A structure of the multi-band antenna module 100 of this embodiment will be described below.

As shown in FIG. 1, in this embodiment, the multi-band antenna module 100 (FIG. 3) includes a main radiator 110, a first radiator 120, a second radiator 130, a third radiator 140 and a fourth radiator 150. In this embodiment, the main radiator 110, the first radiator 120, the second radiator 130, the third radiator 140 and the fourth radiator 150 are adapted to form a 3D structure along outlines of the bottom surface 11 (FIG. 5), the top surface 12 and the lateral surfaces 15*a*, 15*b*, 15*c*, 15*d*, 15*e* and 15*f* of the casing 10.

Specifically, in this embodiment, as shown in FIG. 3, the main radiator 110 includes a section 111 and two branches 112 and 114 connected to the section 111, and the two branches 112 and 114 have multiple bends and thus are adapted to extend from the bottom surface 11 (FIG. 5) to the top surface 12 along at least one of these lateral surfaces 15*a*, 15*b*, 15*c*, 15*d*, 15*e* and 15*f*.

Specifically, the two branches 112 and 114 have sections 1122 and 1142 (FIG. 5) located on the bottom surface 11 (FIG. 5), sections 1124 and 1144 (FIG. 3) located on the lateral surface 15*e* and sections 1126 and 1146 (FIG. 3) located on the inclined surface 14*b*. The sections 1126 and 1146 are connected to the section 111 located on the top surface 12. As shown in FIG. 5, the main radiator 110 has a feed-in terminal 116 and a first ground terminal 118. The feed-in terminal 116 and the first ground terminal 118 are located on the two sections 1122 and 1142 respectively and located on the bottom surface 11 of the casing 10.

In addition, as shown in FIG. 1, the first radiator 120 has multiple bends and thus is adapted to extend from the top surface 12 to the lateral surfaces. More specifically, as shown in FIG. 3, the first radiator 120 is connected to the section 111 of the main radiator by virtue of an end portion 121, and the first radiator 120 has a section 122 disposed on the top surface 12 (FIG. 1), a section 123 disposed on the inclined surface 14*a* (FIG. 1) of the casing 10 (FIG. 1) and sections 124, 125, 126 and 127 disposed on the lateral surfaces 15*a*, 15*b* and 15*c* (FIG. 1) of the casing 10 (FIG. 1).

In this embodiment, the first radiator 120 is configured to couple a first frequency band. A length of the first radiator 120 is, for example, a ¼ wavelength of the first frequency band. In this embodiment, the first frequency band is, for example, a frequency band of 824 MHz to 894 MHz of a low frequency, but the first frequency band is not limited thereto.

In addition, in this embodiment, the section 125, located on the lateral surface 15*a*, of the first radiator 120 may be configured to assist in resonance in the low frequency. Certainly, in other embodiments, a shape of the first radiator 120 is not limited thereto.

As shown in FIG. 4, in this embodiment, the second radiator 130 is connected to the main radiator 110 and has a first section 132 and second section 134 which are connected with each other in a bending manner. The first section 132 and the second section 134 are adapted to be disposed on one of these lateral surfaces 15*a*, 15*b*, 15*c*, 15*d*, 15*e* and 15*f* of the casing 10 (FIG. 1). Specifically, the first section 132 is connected to the section 1144 of the main radiator and located on the lateral surface 15*d* (FIG. 1), and an extending direction of the first section 132 is perpendicular to an extending direction of the section 1144. The second section 134 is located on the lateral surface 15*c* (FIG. 1), and the second section 134 is L-shaped and extends in a direction (downwards) to the bottom surface 11 (FIG. 1) at a tail end.

In this embodiment, the second radiator 130 is configured to couple a second frequency band. A length of the second radiator 130 is, for example, a ¼ wavelength of the second frequency band. The second frequency band is, for example, a frequency band of 1.71 GHz to 1.88 GHz in part of an intermediate frequency, but the second frequency band is not limited thereto.

In addition, as shown in FIG. 4, in this embodiment, the third radiator 140 is connected to the main radiator 110, and the third radiator 140 is adapted to be disposed on the top surface 12 (FIG. 1). In this embodiment, a shape of the third radiator 140 is close to a Z shape and has two bends, but the shape of the third radiator 140 is not limited thereto. The third radiator 140 is configured to couple a third frequency band. A length of the third radiator 140 is, for example, a ¼ wavelength of the third frequency band. The third frequency band is, for example, a frequency band of 2.3 GHz to 2.69 GHz of a high frequency, but the third frequency band is not limited thereto.

As shown in FIG. 4, in this embodiment, the fourth radiator 150 is located beside the main radiator 110. The fourth radiator 150 has multiple bends and thus is adapted to extend from the bottom surface 11 (FIG. 5) to the top surface 12 (FIG. 2) through at least two of these lateral surfaces 15*a*, 15*b*, 15*c*, 15*d*, 15*e* and 15*f* (FIG. 2). Specifically, the fourth radiator 150 includes a section 151 located on the bottom surface 11 (FIG. 5), a section 152 located on the lateral surface 15*e* (FIG. 2), a section 153 located on the lateral surface 15*f* (FIG. 2), a section 154 located on the inclined surface 14*c* (FIG. 2) and a section 155 located on the top surface 12 (FIG. 2).

In this embodiment, the fourth radiator 150 has a second ground terminal 156 located on the section 151. The section 152 is L-shaped and extends rightwards. The section 153 is perpendicular to the section 154 and has a bend. The fourth radiator 150 extends to the top surface 12 (FIG. 2) of the casing 10 (FIG. 2) by virtue of the section 155, so that interference of a metal outside the casing 10 (for example, a metal shell (not shown) wound on the lateral surfaces 15*a*, 15*b*, 15*c*, 15*d*, 15*e* and 15*f* (FIG. 2) of the casing 10) may be avoided, and antenna efficiency may further be improved.

The fourth radiator 150 is configured to couple a fourth frequency band. A length of the fourth radiator 150 is, for example, a ¼ wavelength of the fourth frequency band. The fourth frequency band is, for example, a frequency band of 1.99 GHz to 2.17 GHz in the other part of the intermediate frequency, but the fourth frequency band is not limited thereto.

In addition, back to FIG. 1, in this embodiment, the casing 10 has a notch 13 in which internal metal components (not shown) may be disposed. Disposing the multi-band antenna module 100 on an outer surface of the casing 10 may also avoid an antenna signal being shielded by the internal metal components.

It is to be noted that, as shown in FIG. 5, in this embodiment, the multi-band antenna module 100 may optionally further include a variable capacitor 160 electrically connected to the feed-in terminal 116. The variable capacitor 160 may change, for example, between 0.1 pF to 0.8 pF to regulate impedance matching to increase a bandwidth or shift the frequency band. Certainly, a capacitance range of the variable capacitor 160 is not limited thereto.

Since different countries specify slightly different frequency bands and have different requirements on antenna efficiency of the same frequency band, specific capacitance values may be written into the variable capacitor 160 of the multi-band antenna module 100 of this embodiment for adaptation to specifications of different countries. For example, a producer may set a variable capacitor 160 of a product to be sold in Country A to be a capacitor value a (for example, written in a software manner) to ensure that a frequency band coupled by a multi-band antenna module 100 of the product is consistent with a specification of Country A. For Country B, the producer may also set a variable capacitor 160 of a product to be sold in Country B to be a capacitor value b to ensure that a frequency band coupled by a multi-band antenna module 100 of the product is consistent with a specification of Country B. Therefore, multi-band antenna modules 100 of products sold to different countries may have the same hardware structure, and producing hardware of different versions for different countries is avoided.

Figure 6:
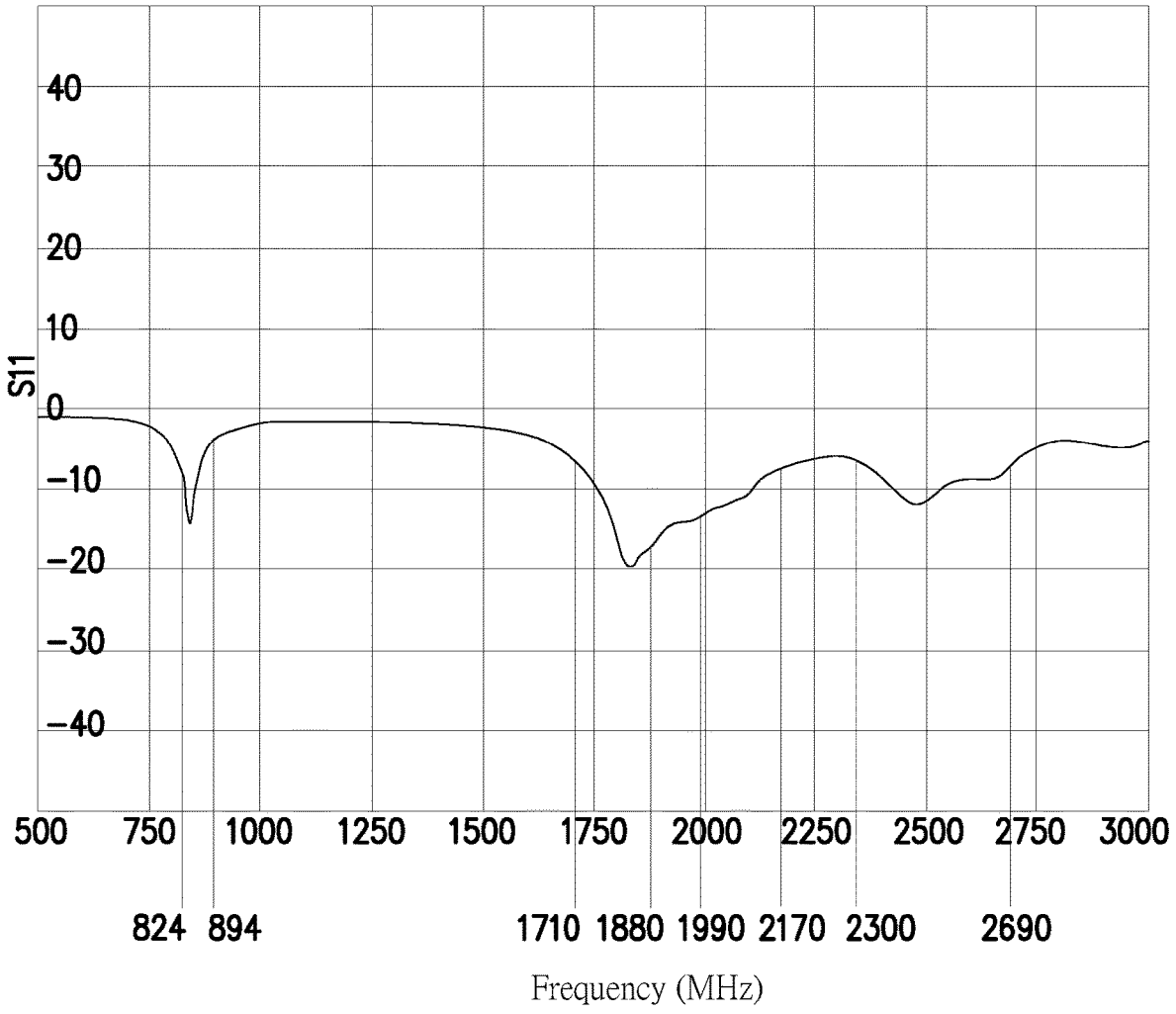
FIG. 6 is a schematic diagram of frequency-S11 when the multi-band antenna module of FIG. 1 is not connected in series with a variable capacitor.
Figure 7:
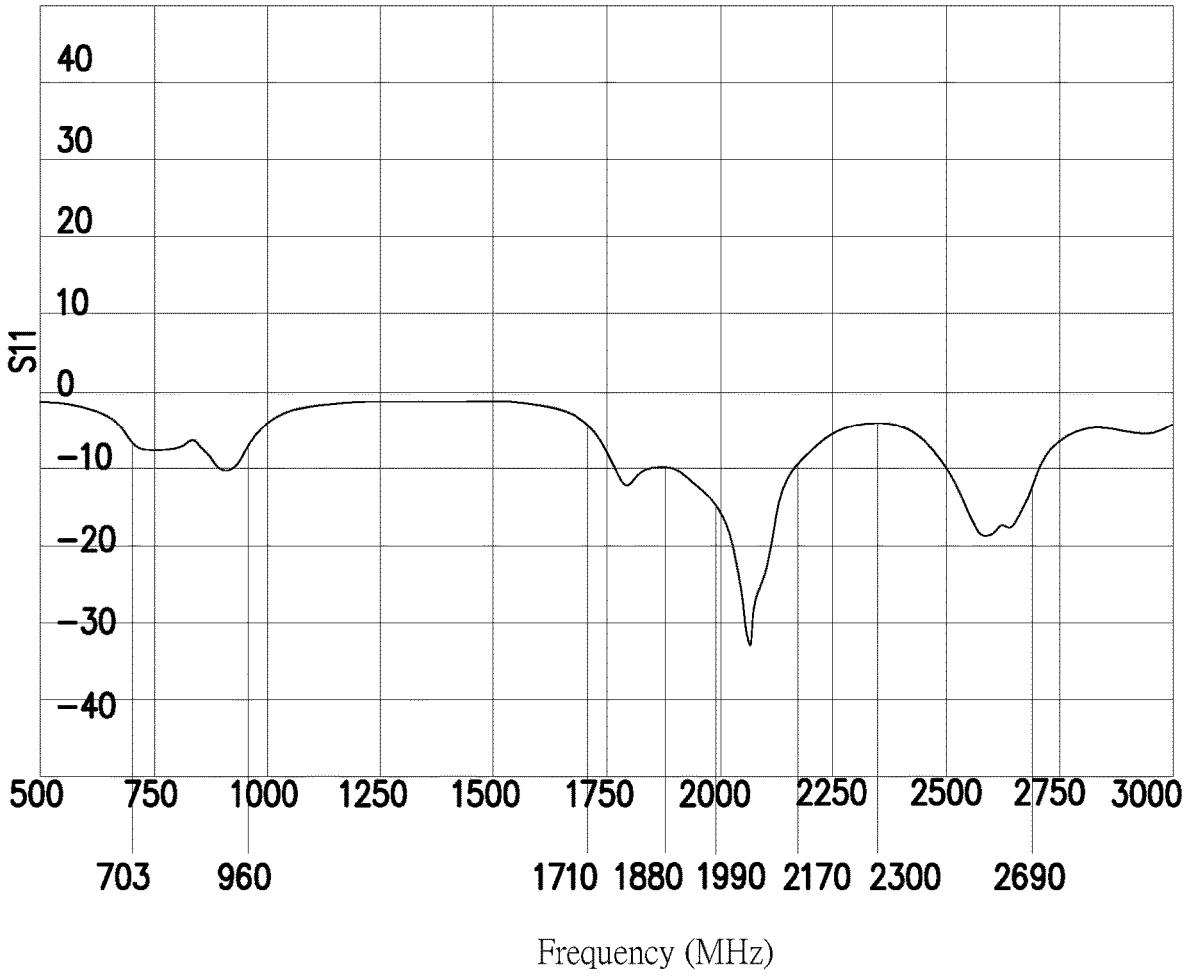
FIG. 7 is a schematic diagram of frequency-S11 when the multi-band antenna module of FIG. 1 is connected in series with the variable capacitor.

FIG. 6 is a schematic diagram of frequency-S11 when the multi-band antenna module of FIG. 1 is not connected in series with a variable capacitor. FIG. 7 is a schematic diagram of frequency-S11 when the multi-band antenna module of FIG. 1 is connected in series with the variable capacitor. Referring to FIG. 6 and FIG. 7, comparison between the two figures shows that the low frequency in FIG. 6 is between 824 MHz and 894 MHz. As shown in FIG. 7, when the multi-band antenna module 100 is connected in series with the variable capacitor 160, the bandwidth of the low frequency is increased to 703 MHz to 960 MHz, and a broadband effect may be achieved.

In addition, when the multi-band antenna module 100 is connected in series with the variable capacitor 160, a numerical value of S11 in part of the intermediate frequency, particularly between 1,990 MHz to 2,170 MHz, is relatively small, and antenna efficiency is relatively high. Moreover, when the multi-band antenna module 100 is connected in series with the variable capacitor 160, the frequency band of the high frequency (2,300 MHz to 2,690 MHz) is also shifted rightwards.

Figure 8:
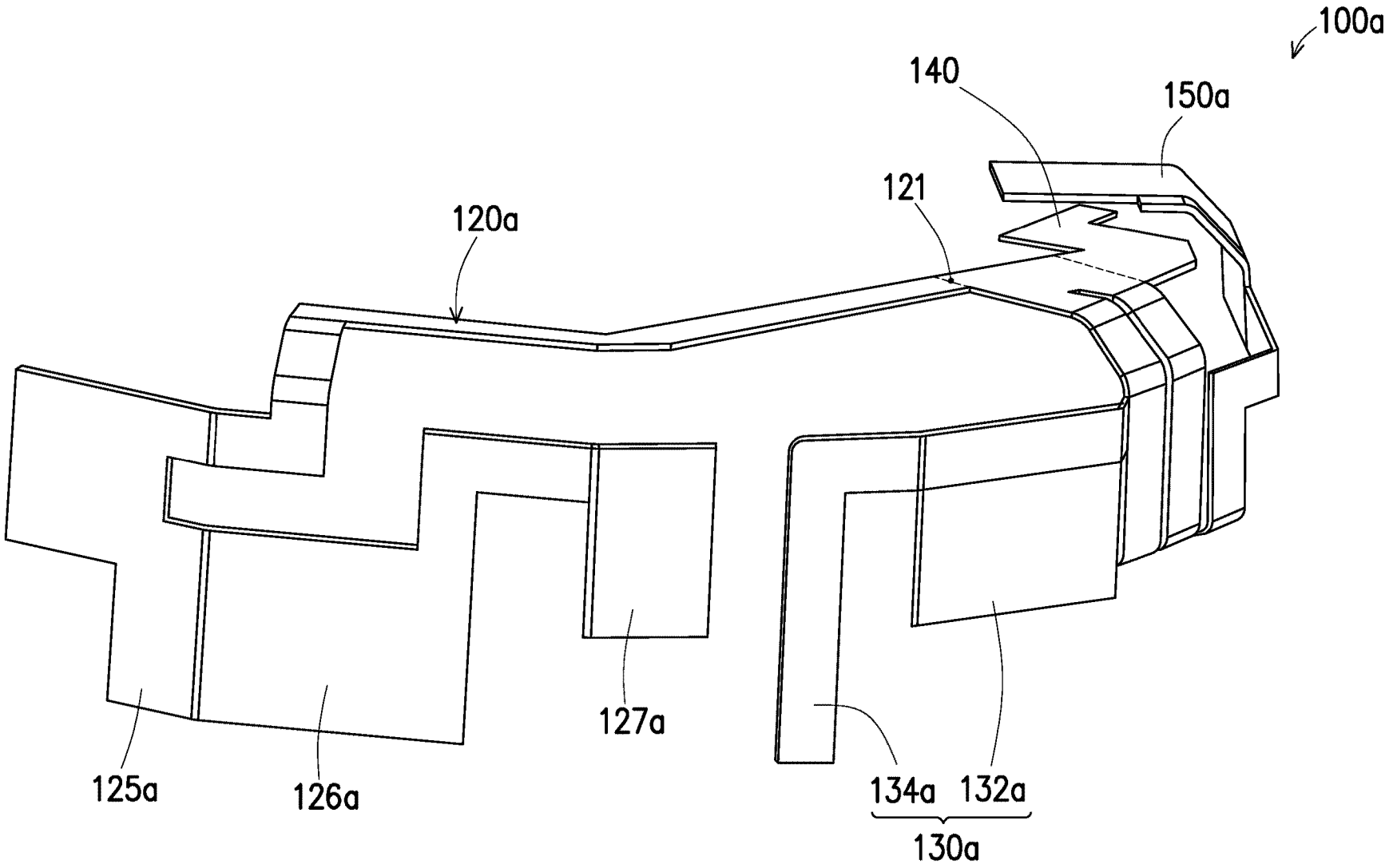
FIG. 8 is a schematic diagram of a multi-band antenna module according to another embodiment of the present invention.
Figure 9:
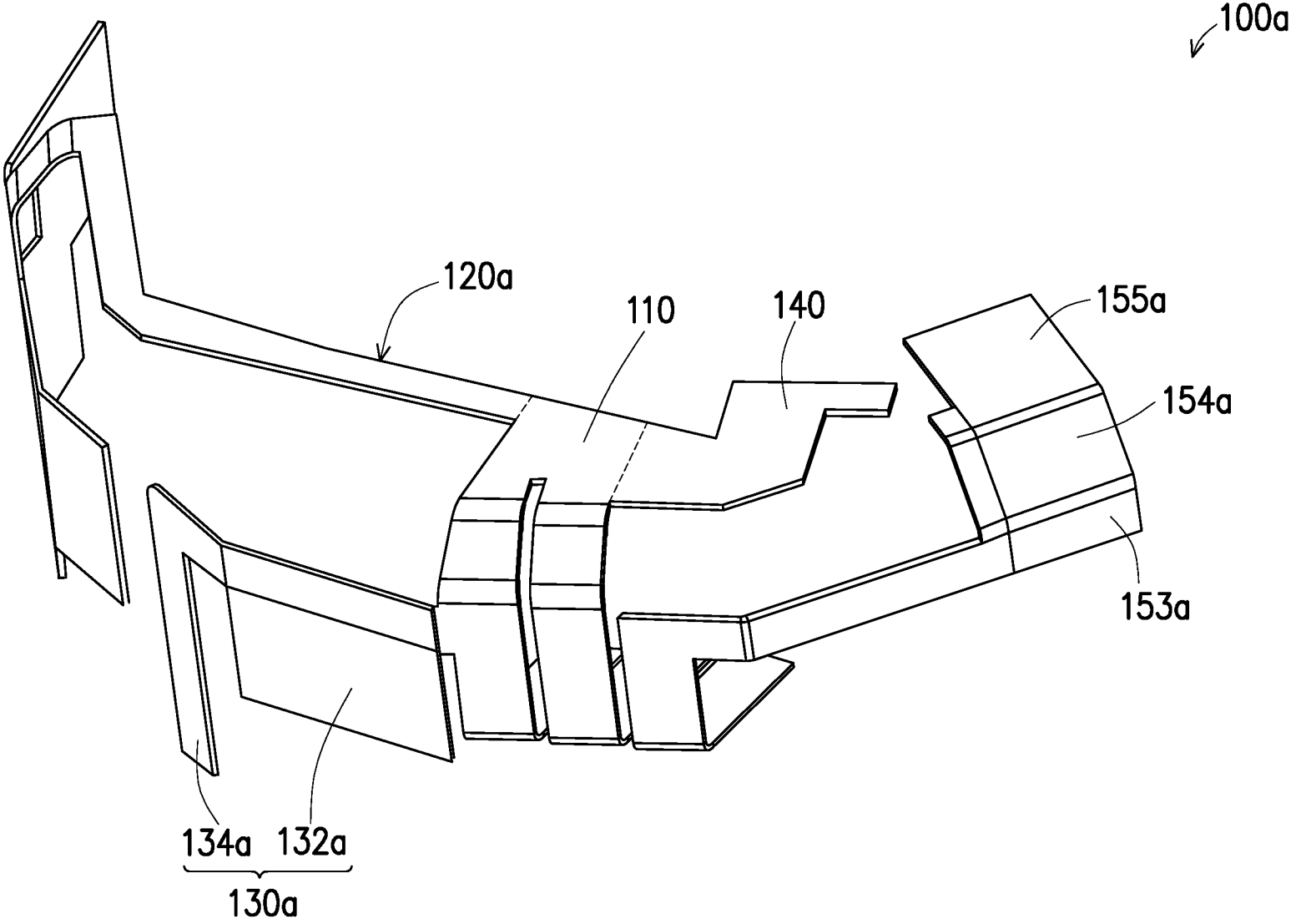
FIG. 9 is a schematic diagram of FIG. 8 at another viewing angle.

FIG. 8 is a schematic diagram of a multi-band antenna module according to another embodiment of the present invention. FIG. 9 is a schematic diagram of FIG. 8 at another viewing angle. Referring to FIG. 8 and FIG. 9, a main difference between the multi-band antenna module 100*a* of this embodiment and the multi-band antenna module 100 of FIG. 1 is that, in this embodiment, a first radiator 120*a* has a first widened section 125*a*, a second widened section 126*a* and a third widened section 127*a* and widths of the first widened section 125*a*, the second widened section 126*a* and the third widened section 127*a* are larger than a width of an end portion 121.

In addition, as shown in FIG. 9, in this embodiment, a width of a first section 132*a* of a second radiator 130*a* is larger than a width of a second section 134*a*. Compared with the multi-band antenna module 100 of FIG. 4, sections 153*a*, 154*a* and 155*a* of a fourth radiator 150*a* in this embodiment are also widened. In this embodiment, the designer may widen local sections of the first radiator 120*a*, the second radiator 130*a* or/and the fourth radiator 150*a* to achieve a frequency modulation effect.

Based on the above, the multi-band antenna module of the present invention has the main radiator, the first radiator, the second radiator, the third radiator and the fourth radiator and thus may couple multiple frequency bands. In addition, the multi-band antenna module of the present invention is adapted to form the 3D structure along the outlines of the bottom surface, the top surface and the lateral surfaces of the casing, thereby effectively saving the space.

The present invention has been disclosed above with the embodiments but is not limited thereto. Those of ordinary skill in the art may make some modifications and embellishments without departing from the spirit and scope of the present invention. Therefore, the scope of protection of the present invention should be defined by the appended claims.

What is claimed is:

1. A multi-band antenna module, adapted to be disposed on a casing and comprising:

a main radiator, comprising a feed-in terminal and a first ground terminal;

a first radiator, connected to the main radiator and configured to couple a first frequency band;

a second radiator, connected to the main radiator and configured to couple a second frequency band;

a third radiator, connected to the main radiator and configured to couple a third frequency band; and a fourth radiator, located beside the main radiator, configured to couple a fourth frequency band and comprising a second ground terminal, wherein the main radiator, the first radiator, the second radiator, the third radiator and the fourth radiator are adapted to form a 3D structure along an outline of the casing, wherein the casing comprises a bottom surface, a top surface and a plurality of lateral surfaces between the bottom surface and the top surface, the main radiator comprises two branches, the feed-in terminal and the first ground terminal are located on the two branches respectively, the feed-in terminal and the first ground terminal are adapted to be located on the bottom surface, the two branches comprise a plurality of bends and thus are adapted to extend from the bottom surface to the top surface along at least one of the lateral surfaces, and the first radiator comprises a bend and thus is adapted to extend from the top surface to one of the lateral surfaces.

2. The multi-band antenna module according to claim 1, wherein a part, on the one of the lateral surfaces, of the first radiator resonates in the first frequency band.

3. The multi-band antenna module according to claim 1, wherein the first radiator comprises an end portion connected to the main radiator, the first radiator comprises a first widened section, a second widened section and a third widened section which are adapted to be located on three of the lateral surfaces respectively, and widths of the first widened section, the second widened section and the third widened section are larger than a width of the end portion.

4. The multi-band antenna module according to claim 1, wherein the second radiator comprises a first section and a second section which are connected with each other in a bending manner and adapted to be disposed on two of the lateral surfaces.

5. The multi-band antenna module according to claim 4, wherein a width of the first section is larger than a width of the second section.

6. The multi-band antenna module according to claim 1, wherein the third radiator is adapted to be disposed on the top surface.

7. The multi-band antenna module according to claim 1, wherein the fourth radiator comprises a plurality of bends and thus is adapted to extend from the bottom surface to the top surface through at least two of the lateral surfaces.

8. The multi-band antenna module according to claim 1, further comprising a variable capacitor electrically connected to the feed-in terminal.

* * * * *